US009463550B2

(12) United States Patent
McClain et al.

(10) Patent No.: US 9,463,550 B2
(45) **Date of Patent: *Oct. 11, 2016**

(54) METHOD OF MANUFACTURING CHEMICAL MECHANICAL POLISHING LAYERS

(71) Applicant: Rohm and Haas Electronic Materials CMP Holdings, Inc., Newark, DE (US)

(72) Inventors: George McClain, Middletown, DE (US); Alan Saikin, Landenberg, PA (US); David Kolesar, Gulph Mills, PA (US); Aaron Sarafinas, Ivyland, PA (US); Robert L. Post, Ivyland, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 162 days.

This patent is subject to a terminal disclaimer.

(21) Appl. No.: 14/184,286

(22) Filed: Feb. 19, 2014

(65) Prior Publication Data

US 2015/0231758 A1 Aug. 20, 2015

(51) Int. Cl.

| | |
|---|---|
| ***B24D 11/00*** | (2006.01) |
| ***B24B 37/24*** | (2012.01) |
| ***B24D 3/32*** | (2006.01) |
| ***B24D 18/00*** | (2006.01) |
| *B24B 37/20* | (2012.01) |
| *B24B 37/22* | (2012.01) |

(52) U.S. Cl.
CPC ..... *B24B 37/24* (2013.01); *B24D 3/32* (2013.01); *B24D 18/0009* (2013.01)

(58) Field of Classification Search
CPC ..... C09K 3/14; B24B 37/02; B24B 37/20; B24B 37/22
See application file for complete search history.

(56) References Cited

U.S. PATENT DOCUMENTS

| | | | | |
|---|---|---|---|---|
| 5,578,362 | A * | 11/1996 | Reinhardt | B24B 37/26 257/E21.219 |
| 7,275,856 | B2 | 10/2007 | Koetas et al. | |
| 7,275,928 | B2 | 10/2007 | Kolesar et al. | |
| 7,396,497 | B2 | 7/2008 | Koetas et al. | |
| 7,517,488 | B2 | 4/2009 | Saikin | |
| 7,537,446 | B2 | 5/2009 | James et al. | |
| 7,947,098 | B2 | 5/2011 | Esbenshade et al. | |
| 2004/0144537 | A1* | 7/2004 | Reddy | C04B 20/0032 166/292 |
| 2006/0108701 | A1 | 5/2006 | Saikin | |
| 2006/0226567 | A1 | 10/2006 | James et al. | |
| 2007/0034614 | A1 | 2/2007 | McClain et al. | |
| 2007/0066196 | A1 | 3/2007 | Saikin | |
| 2007/0210491 | A1 | 9/2007 | Saikin | |

OTHER PUBLICATIONS

Co-pending U.S. Appl. No. 14/184,328, filed Feb. 19, 2014.

* cited by examiner

*Primary Examiner* — Pegah Parvini
(74) *Attorney, Agent, or Firm* — Thomas S. Deibert

(57) ABSTRACT

A method of making a polishing layer for polishing a substrate selected from at least one of a magnetic substrate, an optical substrate and a semiconductor substrate is provided, comprising: providing a liquid prepolymer material; providing a plurality of hollow microspheres; exposing the plurality of hollow microspheres to a carbon dioxide atmosphere for an exposure period to form a plurality of treated hollow microspheres; combining the liquid prepolymer material with the plurality of treated hollow microspheres to form a curable mixture; allowing the curable mixture to undergo a reaction to form a cured material, wherein the reaction is allowed to begin ≤24 hours after the formation of the plurality of treated hollow microspheres; and, deriving at least one polishing layer from the cured material; wherein the at least one polishing layer has a polishing surface adapted for polishing the substrate.

7 Claims, 5 Drawing Sheets

METHOD OF MANUFACTURING CHEMICAL MECHANICAL POLISHING LAYERS

The present invention relates generally to the field of manufacture of polishing layers. In particular, the present invention is directed to a method of manufacturing polishing layers for use in chemical mechanical polishing pads.

In the fabrication of integrated circuits and other electronic devices, multiple layers of conducting, semiconducting and dielectric materials are deposited on or removed from a surface of a semiconductor wafer. Thin layers of conducting, semiconducting, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damage, scratches, and contaminated layers or materials.

Chemical mechanical planarization, or chemical mechanical polishing (CMP), is a common technique used to planarize substrates, such as semiconductor wafers. In conventional CMP, a wafer is mounted on a carrier assembly and positioned in contact with a polishing pad in a CMP apparatus. The carrier assembly provides a controllable pressure to the wafer, pressing it against the polishing pad. The pad is moved (e.g., rotated) relative to the wafer by an external driving force. Simultaneously therewith, a chemical composition ("slurry") or other polishing solution is provided between the wafer and the polishing pad. Thus, the wafer surface is polished and made planar by the chemical and mechanical action of the pad surface and slurry.

Reinhardt et al., U.S. Pat. No. 5,578,362, discloses an exemplary polishing layers known in the art. The polishing layers of Reinhardt comprise a polymeric matrix having hollow microspheres with a thermoplastic shell dispersed throughout. Generally, the hollow microspheres are blended and mixed with a liquid polymeric material and transferred to a mold for curing. Conventionally, strict process controls are required to facilitate production of consistent polishing layers from batch to batch, day to day, and season to season.

Despite implementation of stringent process controls, conventional processing techniques nevertheless result in undesirable variation (e.g., pore size and pore distribution) in polishing layers produced batch to batch, day to day, and season to season. Accordingly, there is a continuing need for improved polishing layer manufacturing techniques to improve product consistency, in particular pore.

The present invention provides a method of making a polishing layer for polishing a substrate selected from at least one of a magnetic substrate, an optical substrate and a semiconductor substrate, comprising: providing a liquid prepolymer material; providing a plurality of hollow microspheres; exposing the plurality of hollow microspheres to a carbon dioxide atmosphere for an exposure period of >3 hours to form a plurality of treated hollow microspheres; combining the liquid prepolymer material with the plurality of treated hollow microspheres to form a curable mixture; allowing the curable mixture to undergo a reaction to form a cured material, wherein the reaction is allowed to begin ≤24 hours after the formation of the plurality of treated hollow microspheres; and, deriving at least one polishing layer from the cured material; wherein the at least one polishing layer has a polishing surface adapted for polishing the substrate.

The present invention provides a method of making a polishing layer for polishing a substrate selected from at least one of a magnetic substrate, an optical substrate and a semiconductor substrate, comprising: providing a liquid prepolymer material; providing a plurality of hollow microspheres, wherein each hollow microsphere in the plurality of hollow microspheres has an acrylonitrile polymer shell; exposing the plurality of hollow microspheres to a carbon dioxide atmosphere for an exposure period of >3 hours to form a plurality of treated hollow microspheres; combining the liquid prepolymer material with the plurality of treated hollow microspheres to form a curable mixture; allowing the curable mixture to undergo a reaction to form a cured material, wherein the reaction is allowed to begin ≤24 hours after the formation of the plurality of treated hollow microspheres; and, deriving at least one polishing layer from the cured material; wherein the at least one polishing layer has a polishing surface adapted for polishing the substrate.

The present invention provides a method of making a polishing layer for polishing a substrate selected from at least one of a magnetic substrate, an optical substrate and a semiconductor substrate, comprising: providing a liquid prepolymer material, wherein the liquid prepolymer material reacts to form a poly(urethane); providing a plurality of hollow microspheres, wherein each hollow microsphere in the plurality of hollow microspheres has a poly(vinylidene dichloride)/polyacrylonitrile copolymer shell and wherein the poly(vinylidene dichloride)/polyacrylonitrile copolymer shell encapsulates an isobutane; exposing the plurality of hollow microspheres to a carbon dioxide atmosphere by fluidizing the plurality of hollow microspheres using a gas for an exposure period of ≥5 hours to form a plurality of treated hollow microspheres, wherein the gas is >30 vol % $CO_2$; combining the liquid prepolymer material with the plurality of treated hollow microspheres to form a curable mixture; allowing the curable mixture to undergo a reaction to form a cured material, wherein the reaction is allowed to begin ≤24 hours after the formation of the plurality of treated hollow microspheres; and, deriving at least one polishing layer from the cured material; wherein the at least one polishing layer has a polishing surface adapted for polishing the substrate.

The present invention provides a method of making a polishing layer for polishing a substrate selected from at least one of a magnetic substrate, an optical substrate and a semiconductor substrate, comprising: providing a mold; providing a liquid prepolymer material; providing a plurality of hollow microspheres; exposing the plurality of hollow microspheres to a carbon dioxide atmosphere for an exposure period of >3 hours to form a plurality of treated hollow microspheres; combining the liquid prepolymer material with the plurality of treated hollow microspheres to form a curable mixture; transferring the curable mixture into the mold; allowing the curable mixture to undergo a reaction to form a cured material, wherein the reaction is allowed to begin ≤24 hours after the formation of the plurality of treated hollow microspheres; wherein the curable mixture undergoes the reaction to form the cured material in the mold; and, deriving at least one polishing layer from the cured material;

wherein the at least one polishing layer has a polishing surface adapted for polishing the substrate.

The present invention provides a method of making a polishing layer for polishing a substrate selected from at least one of a magnetic substrate, an optical substrate and a semiconductor substrate, comprising: providing a mold; providing a liquid prepolymer material, wherein the liquid prepolymer material reacts to form a poly(urethane); providing a plurality of hollow microspheres, wherein each hollow microsphere in the plurality of hollow microspheres has a poly(vinylidene dichloride)/polyacrylonitrile copolymer shell and wherein the poly(vinylidene dichloride)/polyacrylonitrile copolymer shell encapsulates an isobutane; exposing the plurality of hollow microspheres to a carbon dioxide atmosphere by fluidizing the plurality of hollow microspheres using a gas for an exposure period of ≥5 hours to form a plurality of treated hollow microspheres, wherein the gas is ≥98 vol % $CO_2$; combining the liquid prepolymer material with the plurality of treated hollow microspheres to form a curable mixture; transferring the curable mixture into the mold; allowing the curable mixture to undergo a reaction to form a cured material, wherein the reaction is allowed to begin ≤24 hours after the formation of the plurality of treated hollow microspheres; wherein the curable mixture undergoes the reaction to form the cured material in the mold; and, deriving at least one polishing layer from the cured material by skiving the cured material to for the at least one polishing layer; wherein the at least one polishing layer has a polishing surface adapted for polishing the substrate.

DETAILED DESCRIPTION

Figure 1:
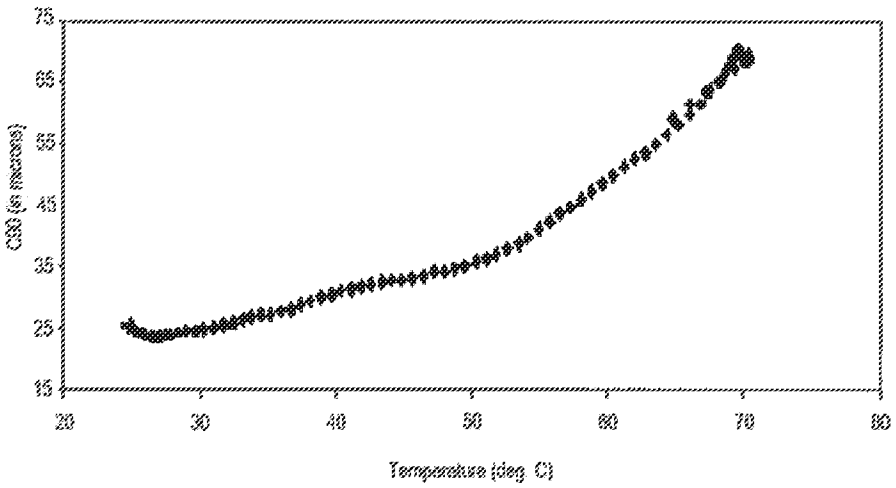
FIG. 1 is a graph of the C90 vs. temperature warm up curve for a plurality of hollow microspheres treated with nitrogen for an exposure period of eight hours.

Surprisingly, it has been found that the sensitivity of pore size in polishing layers to process conditions can be significantly reduced through treatment of a plurality of hollow microspheres before they are combined with a liquid prepolymer material to form a curable mixture from which the polishing layers are formed. Specifically, it has been found that by treating the plurality of hollow microspheres as described herein, wider process temperature variations can be tolerated within a batch (e.g., within a mold), from batch to batch, from day to day, and from season to season, while continuing to produce polishing layers having a consistent pore size, pore count and specific gravity. The consistency of pore size and pore count is particularly critical in polishing layers incorporating the plurality of hollow microspheres, wherein the hollow microspheres in the plurality of hollow microspheres each have a thermally expandable polymeric shell. That is, the specific gravity of the polishing layer produced using the same loading (i.e., wt % or count) of hollow microspheres included in the curable material will vary depending on the actual size (i.e., diameter) of the hollow microspheres upon curing of the curable material.

The term "poly(urethane)" as used herein and in the appended claims encompasses (a) polyurethanes formed from the reaction of (i) isocyanates and (ii) polyols (including diols); and, (b) poly(urethane) formed from the reaction of (i) isocyanates with (ii) polyols (including diols) and (iii) water, amines or a combination of water and amines.

The term "gel point" as used herein and in the appended claims in reference to a curable mixture means the moment in the curing process when the curable mixture exhibits an infinite steady-shear viscosity and a zero equilibrium modulus.

The term "mold cure temperature" as used herein and in the appended claims refers to the temperature exhibited by the curable mixture during the reaction to form the cured material.

The term "maximum mold cure temperature" as used herein and in the appended claims refers to the maximum temperature exhibited by the curable mixture during the reaction to form the cured material.

The term "gel time" as used herein and in the appended claims in reference to a curable mixture means the total cure time for that mixture as determined using a standard test method according to ASTM D3795-00a (Reapproved 2006) (*Standard Test Method for Thermal Flow, Cure, and Behavior Properties of Pourable Thermosetting Materials by Torque Rheometer*).

The liquid prepolymer material preferably reacts (i.e., cures) to form a material selected from poly(urethane), polysulfone, polyether sulfone, nylon, polyether, polyester, polystyrene, acrylic polymer, polyurea, polyamide, polyvinyl chloride, polyvinyl fluoride, polyethylene, polypropylene, polybutadiene, polyethylene imine, polyacrylonitrile, polyethylene oxide, polyolefin, poly(alkyl)acrylate, poly (alkyl)methacrylate, polyamide, polyether imide, polyketone, epoxy, silicone, polymer formed from ethylene propylene diene monomer, protein, polysaccharide, polyacetate and a combination of at least two of the foregoing. Preferably, the liquid prepolymer material reacts to form a material comprising a poly(urethane). More preferably, the liquid prepolymer material reacts to form a material comprising a polyurethane. Most preferably, the liquid prepolymer material reacts (cures) to form a polyurethane.

Preferably, the liquid prepolymer material comprises a polyisocyanate-containing material. More preferably, the liquid prepolymer material comprises the reaction product of a polyisocyanate (e.g., diisocyanate) and a hydroxyl-containing material.

Preferably, the polyisocyanate is selected from methylene his 4,4'-cyclohexyl-isocyanate; cyclohexyl diisocyanate; isophorone diisocyanate; hexamethylene diisocyanate; propylene-1,2-dissocyanate; tetramethylene-1,4-diisocyanate; 1,6-hexamethylene-diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of hexamethylene diisocyanate; triisocyanate of 2,4,4-trimethyl-1,6-hexane diisocyanate; urtdione of hexamethylene diisocyanate; ethylene diisocyanate; 2,2,4-trimethylhexamethylene diisocyanate; 2,4,4-tri-methylhexamethylene diisocyanate; dicyclohexylmethane diisocyanate; and combinations thereof. Most preferably, the polyisocyanate is aliphatic and has less than 14 percent unreacted isocyanate groups.

Preferably, the hydroxyl-containing material used with the present invention is a polyol. Exemplary polyols include, for example, polyether polyols, hydroxy-terminated polybutadiene (including partially and fully hydrogenated derivatives), polyester polyols, polycaprolactone polyols, polycarbonate polyols, and mixtures thereof.

Preferred polyols include polyether polyols. Examples of polyether polyols include polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups. Suitable polycaprolactone polyols include, but are not limited to, 1,6-hexanediol-initiated polycaprolactone; diethylene glycol initiated polycaprolactone; trimethylol propane initiated polycaprolactone; neopentyl glycol initiated polycaprolactone; 1,4-butanediol-initiated polycaprolactone; PTMEG-initiated polycaprolactone; and mixtures thereof. The hydrocarbon chain can have saturated or unsaturated bonds, or substituted or unsubstituted aromatic and cyclic groups. Suitable polycarbonates include, but are not limited to, polyphthalate carbonate and poly(hexamethylene carbonate) glycol.

Preferably, the plurality of hollow microspheres is selected from gas filled hollow core polymeric materials and liquid filled hollow core polymeric materials, wherein the hollow microspheres in the plurality of hollow microspheres each have a thermally expandable polymeric shell. Preferably, the thermally expandable polymeric shell is comprised of a material selected from the group consisting of polyvinyl alcohols, pectin, polyvinyl pyrrolidone, hydroxyethylcellulose, methylcellulose, hydropropylmethylcellulose, carboxymethylcellulose, hydroxypropylcellulose, polyacrylic acids, polyacrylamides, polyethylene glycols, polyhydroxyetheracrylites, starches, maleic acid copolymers, polyethylene oxide, polyurethanes, cyclodextrin and combinations thereof. More preferably, the thermally expandable polymeric shell comprises an acrylonitrile polymer (preferably, wherein the acrylonitrile polymer is an acrylonitrile copolymer; more preferably, wherein the acrylonitrile polymer is an acrylonitrile copolymer selected from the group consisting of a poly(vinylidene dichloride)/polyacrylonitrile copolymer and a polyacrylonitrile/alkylacrylonitrile copolymer; most preferably, wherein the acrylonitrile polymer is a poly(vinylidene dichloride)/polyacrylonitrile copolymer). Preferably, the hollow microspheres in the plurality of hollow microspheres are gas filled hollow core polymeric materials, wherein the thermally expandable polymeric shell encapsulates a hydrocarbon gas. Preferably, the hydrocarbon gas is selected from the group consisting of at least one of methane, ethane, propane, isobutane, n-butane and isopentane, n-pentane, neo-pentane, cyclopentane, hexane, isohexane, neo-hexane, cyclohexane, heptane, isoheptane, octane and isooctane. More preferably, the hydrocarbon gas is selected from the group consisting of at least one of methane, ethane, propane, isobutane, n-butane, isopentane. Still more preferably, the hydrocarbon gas is selected from the group consisting of at least one of isobutane and isopentane. Most preferably, the hydrocarbon gas is isobutane. The hollow microspheres in the plurality of hollow microspheres are most preferably gas filled hollow core polymeric materials having a copolymer of acrylonitrile and vinylidene chloride shell encapsulating an isobutane (e.g., Expancel® microspheres available from Akzo Nobel).

The curable mixture comprises a liquid prepolymer material and a plurality of treated hollow microspheres. Preferably, the curable mixture comprises a liquid prepolymer material and a plurality of treated hollow microspheres, wherein the plurality of treated hollow microspheres is uniformly dispersed in the liquid prepolymer material. Preferably, the curable mixture exhibits a maximum mold cure temperature of 72 to 90° C. (more preferably, 75 to 85° C.).

The curable mixture optionally further comprises a curing agent. Preferred curing agents include diamines. Suitable polydiamines include both primary and secondary amines. Preferred polydiamines include, but are not limited to, diethyl toluene diamine ("DETDA"); 3,5-dimethylthio-2,4-toluenediamine and isomers thereof; 3,5-diethyltoluene-2,4-diamine and isomers thereof (e.g., 3,5-diethyltoluene-2,6-diamine); 4,4'-bis-(sec-butylamino)-diphenylmethane; 1,4-bis-(sec-butylamino)-benzene; 4,4'-methylene-bis-(2-chloroaniline); 4,4'-methylene-bis-(3-chloro-2,6-diethylaniline) ("MCDEA"); polytetramethyleneoxide-di-p-aminobenzoate; N,N'-dialkyldiamino diphenyl methane; p,p'-methylene dianiline ("MDA"); m-phenylenediamine ("MPDA"); methylene-bis 2-chloroaniline ("MBOCA"); 4,4'-methylene-bis-(2-chloroaniline) ("MOCA"); 4,4'-methylene-bis-(2,6-diethylaniline) ("MDEA"); 4,4'-methylene-bis-(2,3-dichloroaniline) ("MDCA"); 4,4'-diamino-3,3'-diethyl-5,5'-dimethyl diphenylmethane, 2,2',3,3'-tetrachloro diamino diphenylmethane; trimethylene glycol di-p-aminobenzoate; and mixtures thereof. Preferably, the diamine curing agent is selected from 3,5-dimethylthio-2,4-toluenediamine and isomers thereof.

Curing agents can also include diols, triols, tetraols and hydroxy-terminated curatives. Suitable diols, triols, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy) ethoxy]benzene; 1,3-bis-{2-[2-(2-hydroxyethoxy) ethoxy]ethoxy}benzene; 1,4-butanediol; 1,5-pentanediol; 1,6-hexanediol; resorcinol-di-(beta-hydroxyethyl) ether; hydroquinone-di-(beta-hydroxyethyl) ether; and mixtures thereof. Preferred hydroxy-terminated curatives include 1,3-bis(2-hydroxyethoxy) benzene; 1,3-bis-[2-(2-hydroxyethoxy) ethoxy]benzene; 1,3-bis-{2-[2-(2-hydroxyethoxy) ethoxy]ethoxy}benzene; 1,4-butanediol; and mixtures thereof. The hydroxy-terminated and diamine curatives can include one or more saturated, unsaturated, aromatic, and cyclic groups.

The plurality of hollow microspheres is exposed to a carbon dioxide atmosphere for an exposure period of >3 hours (preferably, ≥4.5 hours; more preferably, ≥4.75 hours; most preferably, ≥5 hours) to form a plurality of treated hollow microspheres.

Preferably, the carbon dioxide atmosphere to which the plurality of hollow microspheres is exposed to form the plurality of treated hollow microspheres comprises ≥30 vol % $CO_2$ (preferably, ≥33 vol % $CO_2$; more preferably, ≥90 vol % $CO_2$; most preferably, ≥98 vol % $CO_2$). Preferably, the carbon dioxide atmosphere is an inert atmosphere. Preferably, the carbon dioxide atmosphere contains <1 vol % $O_2$ and <1 vol % $H_2O$. More preferably, the carbon dioxide atmosphere contains <0.1 vol % $O_2$ and <0.1 vol % $H_2O$.

Preferably, the plurality of hollow microspheres is exposed to the carbon dioxide atmosphere by fluidizing the plurality of hollow microspheres using a gas to form the plurality of treated hollow microspheres. More preferably, the plurality of hollow microspheres is exposed to the carbon dioxide atmosphere by fluidizing the plurality of hollow microspheres using a gas for the duration of an exposure period of >3 hours (preferably, ≥4.5 hours; more preferably, ≥4.75 hours; most preferably, ≥5 hours) to form the plurality of treated hollow microspheres; wherein the gas comprises ≥30 vol % $CO_2$ (preferably, ≥33 vol % $CO_2$; more preferably, ≥90 vol % $CO_2$; most preferably, ≥98 vol % $CO_2$) and wherein the gas contains <1 vol % $O_2$ and <1 vol % $H_2O$. Most preferably, the plurality of hollow microspheres is exposed to the carbon dioxide atmosphere by fluidizing the plurality of hollow microspheres using a gas for an exposure period of ≥5 hours to form the plurality of treated hollow microspheres; wherein the gas comprises ≥30 vol % $CO_2$; and, wherein the gas contains <0.1 vol % $CO_2$ and <0.1 vol % $H_2O$.

The plurality of treated hollow microspheres are combined with the liquid prepolymer material to form the curable mixture. The curable mixture is then allowed to undergo a reaction to form a cured material. The reaction to form the cured material is allowed to begin ≤24 hours (preferably, ≤12 hours; more preferably ≤8 hours; most preferably ≤1 hour) after the formation of the plurality of treated hollow microspheres.

Preferably, the curable material is transferred into a mold, wherein the curable mixture undergoes the reaction to form the cured material in the mold. Preferably, the mold can selected from the group consisting of an open mold and a closed mold. Preferably, the curable mixture can transferred into the mold by pouring or injecting. Preferably, the mold is provided with a temperature control system.

At least one polishing layer is derived from the cured material. Preferably, the cured material is a cake, wherein a plurality of polishing layers are derived from the cake. Preferably, the cake is skived, or similarly sectioned, into a plurality of polishing layers of desired thickness. More preferably, a plurality of polishing layers are derived from the cake, by skiving the cake into a plurality of polishing layers using a skiver blade. Preferably, the cake is heated to facilitate the skiving. More preferably, the cake is heated using an infrared heating source during the skiving of the cake to form a plurality of polishing layers. The at least one polishing layer has a polishing surface adapted for polishing the substrate. Preferably, the polishing surface is adapted for polishing the substrate through the incorporation of a macrotexture selected from at least one of perforations and grooves. Preferably, the perforations can extend from the polishing surface part way or all of the way through the thickness of the polishing layer. Preferably, the grooves are arranged on the polishing surface such that upon rotation of the polishing layer during polishing, at least one groove sweeps over the surface of the substrate. Preferably, the grooves are selected from curved grooves, linear grooves and combinations thereof. The grooves exhibit a depth of ≥10 mils (preferably, 10 to 150 mils). Preferably, the grooves form a groove pattern that comprises at least two grooves having a combination of a depth selected from ≥10 mils, ≥15 mils and 15 to 150 mils; a width selected from ≥10 mils and 10 to 100 mils; and a pitch selected from ≥30 mils, ≥50 mils, 50 to 200 mils, 70 to 200 mils, and 90 to 200 mils.

Preferably, the method of making a polishing layer of the present invention, farther comprises: providing a mold; and, transferring the curable mixture into the mold; wherein the curable mixture undergoes the reaction to form the cured material in the mold.

Preferably, the method of making a polishing layer of the present invention, further comprises: providing a mold; providing a temperature control system; transferring the curable mixture into the mold; wherein the curable mixture undergoes the reaction to form the cured material in the mold and wherein the temperature control system maintains a temperature of the curable mixture while the curable mixture undergoes the reaction to form the cured material. More preferably, wherein the temperature control system maintains a temperature of the curable mixture while the curable mixture undergoes the reaction to form the cured material such that a maximum mold cure temperature exhibited by the curable mixture during the reaction to form the cured material is 72 to 90° C.

An important step in substrate polishing operations is the determination of an endpoint to the polishing. One popular in situ method for endpoint detection involves directing a light beam at the substrate surface and analyzing the properties of the substrate surface (e.g., the thickness of films thereon) based on the light reflected back from the substrate surface to determine the polishing endpoint. To facilitate such light based endpoint methods, the polishing layers made using the method of the present invention, optionally, further comprise an endpoint detection window. Preferably, the endpoint detection window is an integral window incorporated into the polishing layer.

Preferably, the method of making a polishing layer of the present invention, further comprises: providing a mold; providing a window block; locating the window block in the mold; and, transferring the curable mixture into the mold; wherein the curable mixture undergoes the reaction to form a the cured material in the mold. The window block can be located in the mold before or after transferring the curable mixture into the mold. Preferably, the window block is located in the mold before transferring the curable mixture into the mold.

Preferably, the method of making a polishing layer of the present invention, further comprises: providing a mold; providing a window block; providing a window block adhesive; securing the window block in the mold; and, then transferring the curable mixture into the mold; wherein the curable mixture undergoes the reaction to form the cured material in the mold. It is believed that securing of the window block to the mold base alleviates the formation of window distortions (e.g., window bulging outward from the polishing layer) when sectioning (e.g., skiving) a cake into a plurality of polishing layers.

Some embodiments of the present invention will now be described in detail in the following Examples.

In the following Examples, a Mettler RC1 jacketed calorimeter outfitted with a temperature controller, a 1 L jacketed glass reactor, an agitator, a gas inlet, a gas outlet, a Lasentec probe and a port on the side wall of the reactor for extending the end of the Lasentec probe into the reactor. The Lasentec probe was used to observe the dynamic expansion of the exemplified treated microspheres as a function of temperature. In particular, with the agitator engaged the set point temperature for the calorimeter was ramped from 25° C. up to 72° C. and then back down from 72° C. to 25° C. (as described in the Examples) while continuously measuring and recording the size of the exemplified treated microspheres as a function of the temperature using the Lasentec probe (with a focused beam reflectance measurement technique). The diameter measurements reported in the Examples are the C90 chord lengths. The C90 chord length is defined as the chord length at which 90% of the actual chord length measurements are smaller.

COMPARATIVE EXAMPLES C1-C2 AND EXAMPLE 1

In each of Comparative Examples C1-C2 and Example 1a plurality of hollow microspheres having a copolymer of acrylonitrile and vinylidene chloride shell encapsulating isobutane (Expancel® DE microspheres available from AkzoNobel) were placed in the bottom of the RC1 calorimeter reactor. The reactor was closed up and a sweep stream of the gas noted in TABLE 1 was then continuously passed through the reactor for the noted exposure period to form a plurality of treated hollow microspheres. The sweep stream was then stopped. The agitator was then engaged to fluidize the plurality of treated hollow microspheres in the reactor. The set point temperature for the RC1 reactor jacket temperature controller was then ramped up linearly from 25° C. to 82° C. over one hour while continuously measuring and recording the size of the treated microspheres as a function of the temperature using the Lasentec probe (with a focused beam reflectance measurement technique). The set point temperature of the RC1 reactor jacket temperature controller was then maintained at 82° C. for thirty (30) minutes before being ramped linearly down from 82° C. to 25° C. over the next thirty (30) minutes while continuously measuring and recording the size of the treated microspheres as a function of the temperature using the Lasentec probe (with a focused beam reflectance measurement technique). The set point temperature of the RC1 reactor jacket temperature controller was then maintained at 25° C. for the next thirty (30) minutes while continuously measuring and recording the size of the treated microspheres as a function of the temperature using the Lasentec probe (with a focused beam reflectance measurement technique).

TABLE 1

Figure 2:
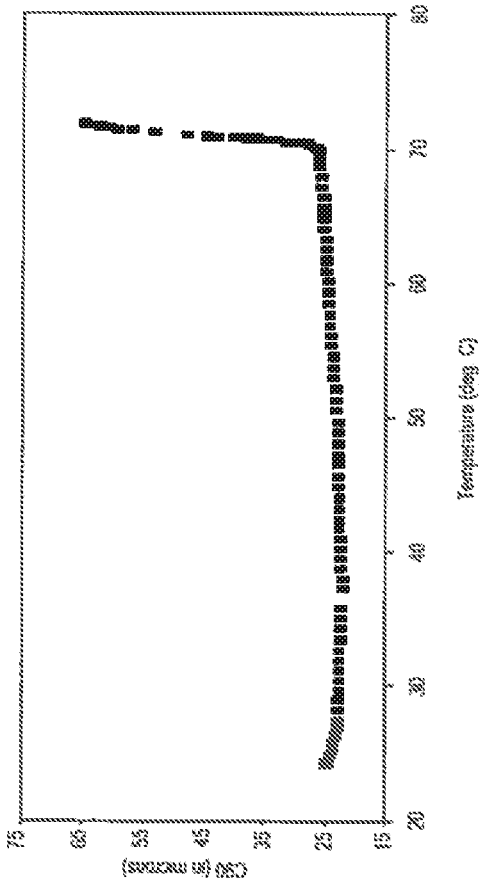
FIG. 2 is a graph of the C90 vs. temperature warm up curve for a plurality of hollow microspheres treated with $CO_2$ for an exposure period of three hours.
Figure 3:
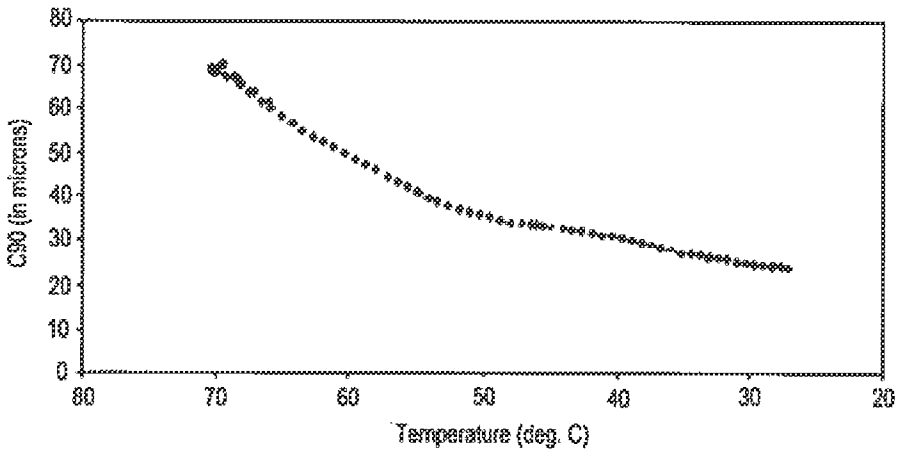
FIG. 3 is a graph of the C90 vs. temperature cool down curve for the plurality of hollow microspheres treated with nitrogen for an exposure period of eight hours.
Figure 4:
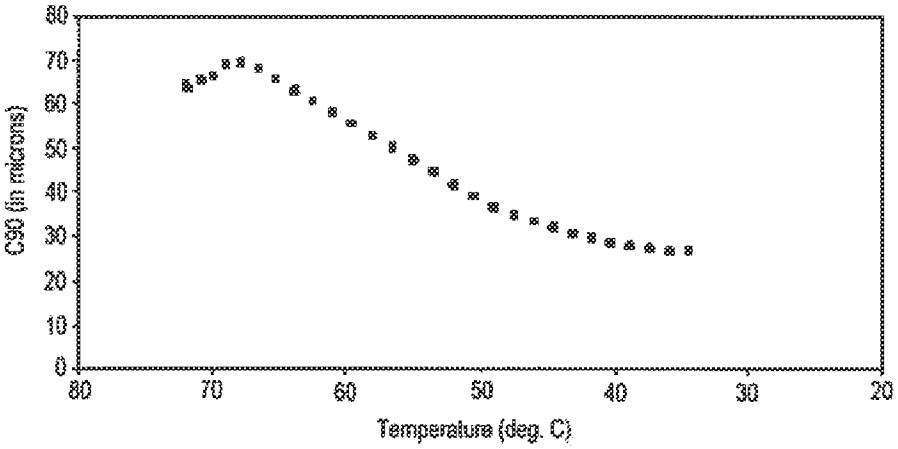
FIG. 4 is a graph of the C90 vs. temperature cool down curve for the plurality of hollow microspheres treated with $CO_2$ for an exposure period of three hours.
Figure 5:
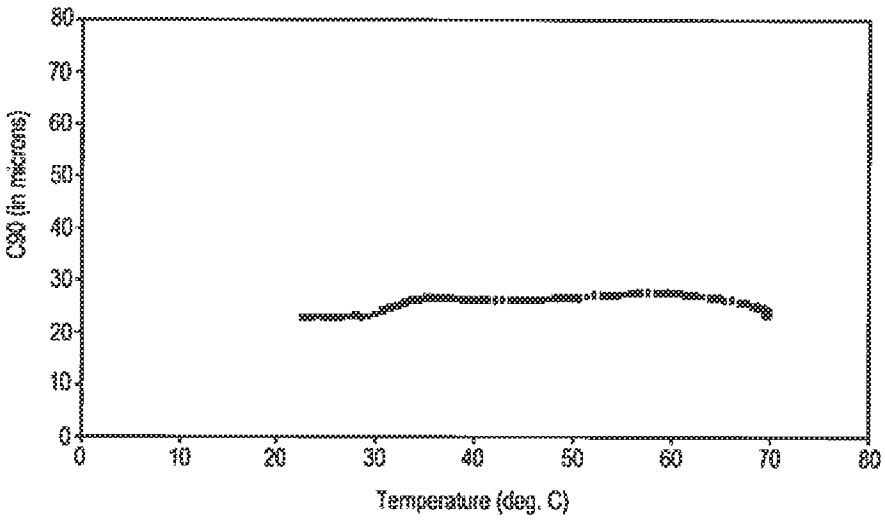
FIG. 5 is a graph of the C90 vs. temperature warm up curve for a plurality of hollow microspheres treated with $CO_2$ for an exposure period of live hours.

| Ex. | Gas | Exposure Period (in hrs) | C90 vs. Temp. ramp up post exposure | C90 vs. Temp. ramp down post exposure |
|---|---|---|---|---|
| C1 | nitrogen | 8 | FIG. 1 | FIG. 3 |
| C2 | $CO_2$ | 3 | FIG. 2 | FIG. 4 |
| 1 | $CO_2$ | 5 | FIG. 5 | — |
| 2 | $CO_2$ | 8 | A | — |
| 3 | $(CO_2 + N_2)$* | 8 | B | — |

* mixture of 33 vol % $CO_2$ and 67 vol % nitrogen
A the C90 vs. temp. ramp up exhibited by the plurality of treated microspheres from Example 2 matched that exhibited by the plurality of treated microspheres from Example 1.
B the C90 vs. temp. ramp up exhibited by the plurality of treated microspheres from Example 3 matched that exhibited by the plurality of treated microspheres from Example 2.

We claim:

1. A method of making a polishing layer for polishing a substrate selected from at least one of a magnetic substrate, an optical substrate and a semiconductor substrate, comprising:

providing a liquid prepolymer material, wherein the liquid prepolymer material reacts to form a material comprising a poly(urethane);

providing a plurality of thermally expandable hollow microspheres; wherein each thermally expandable hollow microsphere in the plurality of thermally expandable hollow microspheres has a poly(vinylidene dichloride)/polyacrylonitrile copolymer shell; and, wherein the poly(vinylidene dichloride)/polyacrylonitrile copolymer shell encapsulates an isobutane;

exposing the plurality of thermally expandable hollow microspheres to a carbon dioxide atmosphere for an exposure period of >3 hours to form a plurality of treated hollow microspheres;

combining the liquid prepolymer material with the plurality of treated hollow microspheres to form a curable mixture;

allowing the curable mixture to undergo a reaction to form a cured material, wherein the reaction is allowed to begin ≤24 hours after the formation of the plurality of treated hollow microspheres; and, deriving at least one polishing layer from the cured material;

wherein the at least one polishing layer has a polishing surface adapted for polishing the substrate.

2. The method of claim 1, wherein the plurality of thermally expandable hollow microspheres is exposed to the carbon dioxide atmosphere by fluidizing the plurality of thermally expandable hollow microspheres using a gas for an exposure period of ≥5 hours to form the plurality of treated hollow microspheres, wherein the gas is ≥30 vol % $CO_2$.

3. The method of claim 1, further comprising:

providing a mold; and, transferring the curable mixture into the mold;

wherein the curable mixture undergoes the reaction to form the cured material in the mold.

4. The method of claim 3, further comprising:

skiving the cured material to form the at least one polishing layer.

5. The method of claim 4, wherein the at least one polishing layer is a plurality of polishing layers.

6. The method of claim 5, wherein the plurality of thermally expandable hollow microspheres is exposed to the carbon dioxide atmosphere by fluidizing the plurality of thermally expandable hollow microspheres using a gas for an exposure period of ≥5 hours to form the plurality of treated hollow microspheres, wherein the gas is ≥30 vol % $CO_2$.

7. The method of claim 6, wherein the reaction is allowed to begin ≤1 hour after the formation of the plurality of treated hollow microspheres.

* * * * *